US006394834B2

(12) United States Patent
Fujimoto et al.

(10) Patent No.: US 6,394,834 B2
(45) **Date of Patent: *May 28, 2002**

(54) INSULATION DISPLACEMENT CONTACT TERMINAL

(75) Inventors: Kei Fujimoto; Tatsuya Ishikawa; Kimihiro Abe, all of Shizuoka-ken (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/365,244

(22) Filed: Jul. 30, 1999

(30) Foreign Application Priority Data

Jul. 31, 1998 (JP) ..... 10-217927

(51) Int. Cl.[7] ..... H01R 4/24
(52) U.S. Cl. ..... 439/397; 439/395
(58) Field of Search ..... 439/397, 399, 439/395, 396, 407, 406, 877, 489, 491

(56) References Cited

U.S. PATENT DOCUMENTS 4,806,120 A * 2/1989 Baker ..... 439/399
5,616,047 A * 4/1997 Lutsch ..... 439/397
5,913,695 A * 6/1999 Okabe ..... 439/397

FOREIGN PATENT DOCUMENTS

JP 57-92762 6/1982

* cited by examiner

*Primary Examiner*—Gary Paumen
*Assistant Examiner*—Alexander Gilman
(74) *Attorney, Agent, or Firm*—Finnegan, Henderson, Farabow, Garrett, & Dunner, L.L.P.

(57) ABSTRACT

An insulation displacement contact terminal has a bottom plate, a pair of side plates, a pair of contact plates, and projecting portions. The side plates respectively extend from both side edges of the bottom plate and oppose each other. The contact plates are respectively partly bent from the side plates and oppose each other. Between the contact plates and the bottom plate are formed gaps. The gaps permit the contact plates to be moved in the direction of their being moved toward each other. Mutually opposing edges of the contact plates define a slot for receiving a clad electric wire therein. The clad electric wire has a core wire and a clothing portion that clothes the core wire. The width of the slot decreases with the movement of the contact plates. With the press insertion of the clad electric wire into the slot, the edges cut into the clothing portions and contact with the core wire. The projecting portions respectively project from the contact plates. The projecting portions are disposed at the bottom of the slot and oppose each other. The clad electric wire that has been pressed toward the bottom plate is made to press the projecting portions, with the result that the movement of the contact plates is caused.

6 Claims, 7 Drawing Sheets

INSULATION DISPLACEMENT CONTACT TERMINAL

BACKGROUND OF THE INVENTION

The present invention relates to an insulation displacement contact terminal that is conducted to a core wire of a clad electric wire by being insulation displacement contacted with the clad electric wire.

An insulation displacement contact terminal that is described in Japanese Patent Application Laid-Open Publication No. S57-92762 is constructed of a pair of contact plates, an insulation displacement contact slot between the contact plates, and a folded-back piece.

When press inserting a clad electric wire into the insulation displacement slot, the contact plate is caused to cut into a clothing portion of the clad electric wire and is brought into contact with the core wire inside the clothing portion. By the press insertion of the clad electric wire, the spacing between the contact plates is increased, whereby the core wire is shaved by the contact plate. For this reason, the contact load between the contact plate and the core wire is decreased with the result that the resistance to contact increases. In addition, the clad electric wire becomes likely to be drawn off from between the insulation displacement contact plates. The folded-back piece is engaged with the clad electric wire in order to prevent the draw-off of the clad electric wire.

However, even when having provided the folded-back piece, the increase in resistance to contact that is due to the increase in the spacing between the contact plates cannot be prevented. Also, the structure of the terminal becomes complex by the extent to which the folded-back piece is provided.

SUMMARY OF THE INVENTION

The present invention has been made in view of the above and has an object to provide an insulation displacement contact terminal wherein the increase in the spacing between the contact plates is reliably prevented; the increase in the resistance to contact is prevented; the structure is simple; and the draw-off of the electric wire is prevented.

To attain the above object; the insulation displacement contact terminal of the present invention is comprised of a bottom plate, a pair of side plates, a pair of contact plates, and projecting portions. The side plates are respectively extended from both side edges of the bottom plate to oppose each other. The contact plates are respectively partly bent from the side plates to oppose each other. Gaps are formed between the contact plates and the bottom plate. These gaps permit the contact plates to be moved in a direction of their being moved toward each other. The edges of the contact plates that oppose each other define a slot for reception therein of a clad electric wire. The clad electric wire has a core wire and a clothing portion that clothes the core wire. The width of the slot decreases as the movements of the contact plates. As the clad electric wire is press inserted into the slot, the edges are caused to cut into the clothing portion and contact with the core wire. The projecting portions are respectively caused to project from their corresponding contact plates. The projecting portions are located or disposed at the bottom of the slot and are caused to oppose each other. The clad electric wire that has been depressed toward the bottom plate presses the projecting portions and this causes the movements of the contact plates.

In the above construction, by press inserting the clad electric wire into the slot, the edges of the contact plates are caused to cut into the clothing portion of the clad electric wire and are thereby conducted to and contacted with the core wire inside the clothing portion. This provides an insulation displacement contact between the clad electric wire and the terminal.

The clad electric wire that has been press inserted into the slot is brought into contact with the projecting portions at the bottom of the slot to thereby press the projecting portions toward the bottom plate. When the projecting portions are pressed, the contact plates are moved in the direction of their being moved toward each other and as a result the with of the slot is decreased. Therefore, the core wire is reliably contacted with the edges of the contact plates over wide regions thereof, with the result that the resistance to contact between the core wire and the contact plates is decreased. Also, the load of contact with the core wire by the edges is increased and so the clad electric wire is firmly held. Accordingly, by a simple structure of providing the contact plates with the projecting portions, it is possible to prevent the draw-off of the clad electric wire.

The width of the slot may be decreased toward the bottom plate.

In this construction, since the width of the slot is decreased toward the bottom plate, regardless of the size of the outside diameter of the clad electric wire the edges are reliably caused to cut into the clothing portion to thereby contact with the core wire. This provides an insulation displacement contact terminal that can cope with a plurality of kinds of clad electric wires each having a different diameter. Further, because the core wires are converged by the edges, the degree of contact between each core wires is also increased.

Each of the edges of the longitudinal walls may have an introduction portion for introducing the clad electric wire into the slot, and a contact portion that cuts into the clothing portion to thereby contact with the core wire.

In this construction, the introduction portion introduces the clad electric wire into the slot and the contact portion cuts into the clothing portion and is thereby conducted to and contacted with the core wire. Therefore, the clad electric wire and the terminal are easily and smoothly contacted with each other by way of insulation displacement contact.

Each of the plates may have an engagement convex portion that is engaged with the clad electric wire for the purpose of retaining the clad electric wire that has been press inserted into the slot.

In this construction, by the engagement convex portion being engaged with the clad electric wire, this clad electric wire is retained in a state of its having pressed the engagement convex portion. Accordingly, between the contact plates and the core wire, a state of contact becomes stable and this provides an excellently maintained state of conduction.

DESCRIPTION OF THE PREFERRED EMBODIMENTS

Embodiments of the present invention will now be explained with reference to the drawings.

Figure 1:
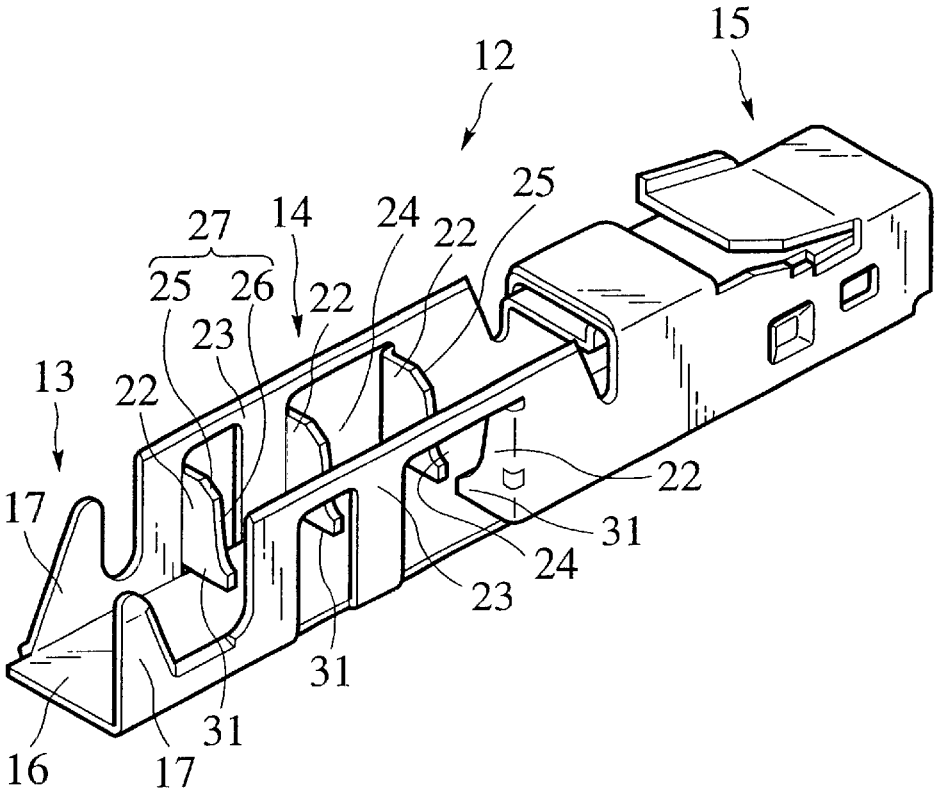
FIG. 1 is a perspective view illustrating an insulation displacement contact terminal as a whole according to an embodiment of the present invention.
Figure 2:
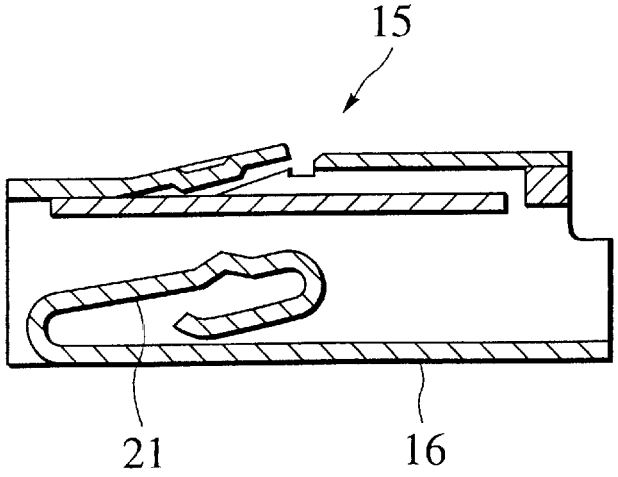
FIG. 2 is a sectional view illustrating a contact portion of the insulation displacement contact terminal of FIG. 1.
Figure 3:
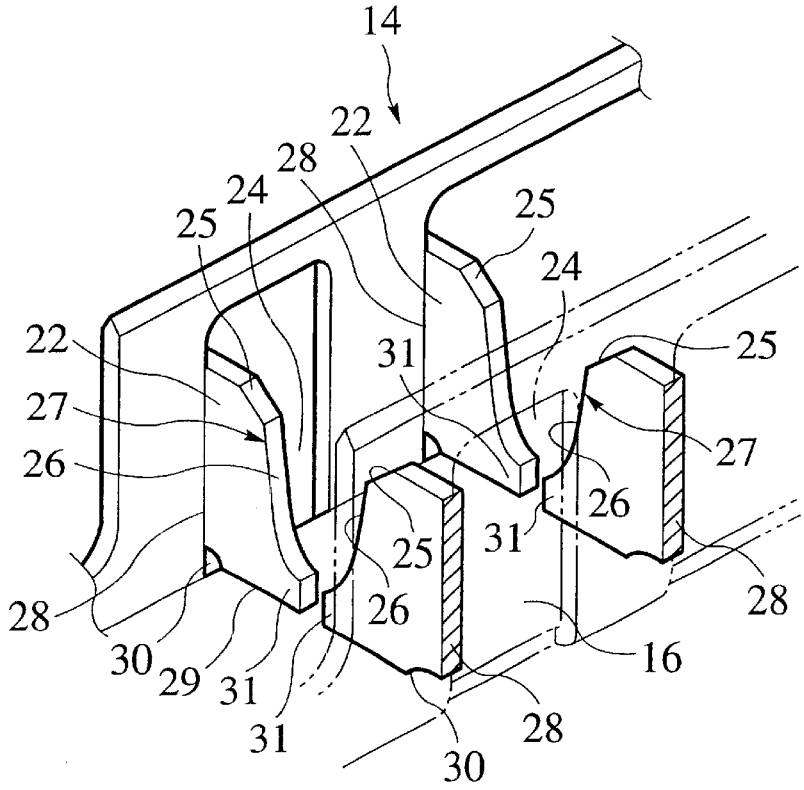
FIG. 3 is a perspective view illustrating an insulation displacement contact portion of the insulation displacement contact terminal of FIG. 1.
Figure 4:
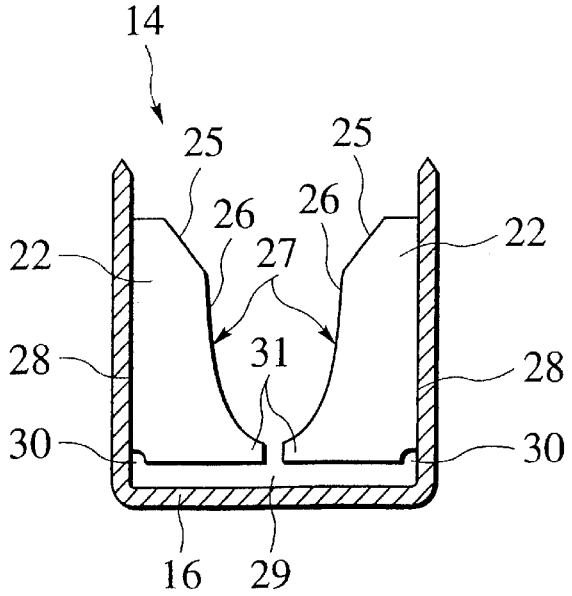
FIG. 4 is a side view of the insulation displacement contact portion.

FIGS. 1 to 5 illustrate an insulation displacement contact terminal 12 according to an embodiment of the present invention. FIG. 1 is a perspective view illustrating the whole of the terminal 12; FIG. 2 is a sectional view illustrating a contact portion thereof; and FIGS. 3 and 4 are a perspective view and a side view illustrating contact plates thereof. As illustrated in FIG. 1, the insulation displacement contact terminal 12 that is formed by being bent from a metal plate has a caulking portion 13, insulation displacement contact portion 14, and contact portion 15. The caulking portion 13, insulation displacement contact portion 14, and contact portion 15 are sequentially disposed along the lengthwise direction of the bottom plate 16.

The caulking portion 13 has a pair of caulking pieces 17 that rise from one end in the lengthwise direction of the bottom plate 16. By a pair of the caulking pieces 17 being caulked, a clad electric wire 18 (see FIG. 5) is fixed to the terminal 1.

The contact portion 15 has a rectangular-cylindrical configuration and is provided at the other end in the lengthwise direction of the bottom plate 16. By a mate terminal (not illustrated) being inserted into the interior of the contact portion 15, the mate terminal and the contact portion 15 are conducted to and contacted with each other. As illustrated in FIG. 2, the contact portion 15 has provided therein an elastic contact piece 21 that obliquely is folded back from the end portion of the bottom plate 16. The elastic contact piece 21 is contacted with the mate terminal.

The insulation displacement contact portion 14 is disposed between the caulking portion 13 and the contact portion 15. The insulation displacement contact portion 14 is conducted to the clad electric wire 18 by its contact with a core wire 19. The insulation displacement contact portion 14 has a plurality of pairs of contact plates 22, 22.

The contact plates 22, 22 are partly cut and bent substantially at right angles from a pair of side plates 23, 23 that rise from both sides of the bottom plate 16. Each pair of the contact plates 22, 22 is disposed opposing each other and extends in a direction of their being moved toward each other. The insulation displacement contact portion 14 has a plurality of pairs (three pairs in the illustrated form) of the contact plates 22, 22 that are spaced away from one another in the lengthwise direction of the side plates 23.

The zones that are situated above a pair of the side plates 23, 23 that rise from the bottom plate 16 are made open. This permits the movements as later described of the contact plates 22, 22.

Each pair of the contact plates 22, 22 have edges that oppose each other. The edges define an insulation displacement contact slot 24 into which the clad electric wire 18 is press inserted. Also, each edge has formed thereon a blade portion 27.

The blade portion 27 includes an introduction portion 25 and a contact portion 26. The introduction portion 25 is provided on a side (the upper part of the illustration) wherein the clad electric wire 18 is inserted and is inclined with respect to the formation direction of the insulation displacement contact slot 24 (the vertical direction with respect to the bottom plate 16). The contact portion 26 extends from the introduction portion 25 toward the bottom plate 16. The introduction portion 25 guides the clad electric wire 18 into the insulation displacement contact slot 24 while, on the other hand, the contact portion 26 is caused to cut into a clothing portion 20 of the clad electric wire 18 to contact with the core wire 19 within the same.

The contact portions 26 that oppose each other have tapered configurations that gradually approach each other in the insertion direction (the direction going toward the bottom plate 16) of the clad electric wire 18. As a result of this, the insulation displacement contact slot 24 between the contact portions 26 has a V-shaped configuration whose width gradually decreases in the insertion direction of the clad electric wire 18. For this reason, the insulation displacement contact slot 24 can cope with a plurality of clad electric wire 18 having different diameters.

Each contact plate 22, 22 is cut and bent from the portion of the corresponding side plate 23, 23 that is spaced from the bottom plate 16. Therefore, the portion of each contact plate 22, 22 other than a connection portion 28 thereof that is connected with the side plate 23 goes floated from the bottom plate 16, whereby a gap 29 is formed between the contact plate 22 and the bottom plate 16.

The end (the lower end of the illustration) approximate to the bottom plate 16, of the connection portion 28 between the contact plate 22, 22 and the side plate 23, 23, has formed therein a circular-arc-like buffer slot portion 30 communicated with the gap 29. The buffer groove portion 30 aids the tilting movement of the contact plate 22, 22 as later described.

The paired contact plates 22, 22 have projectingly formed thereon projecting portions 31 so that these projecting portions may oppose each other. Each projecting portion 31 is provided on the end edge of the corresponding contact portion 26 in the vicinity of the bottom plate 16, and is disposed at the bottom of the insulation displacement contact slot 24. The core wire 19 of the clad electric wire 18 that has been press inserted into the insulation displacement contact slot 24 can be caused to press the projecting portion 31 while being in contact therewith.

Figure 5A:
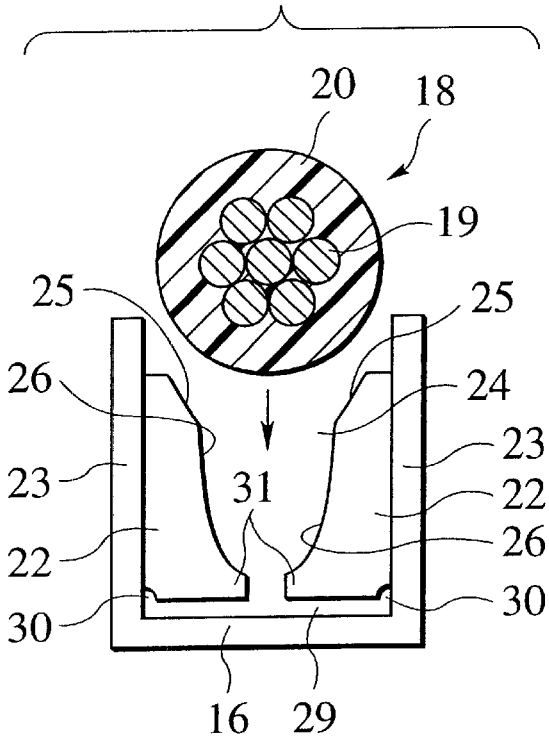
FIG. 5A is a side view illustrating a clad electric wire prior to insulation displacement contact.
Figure 5B:
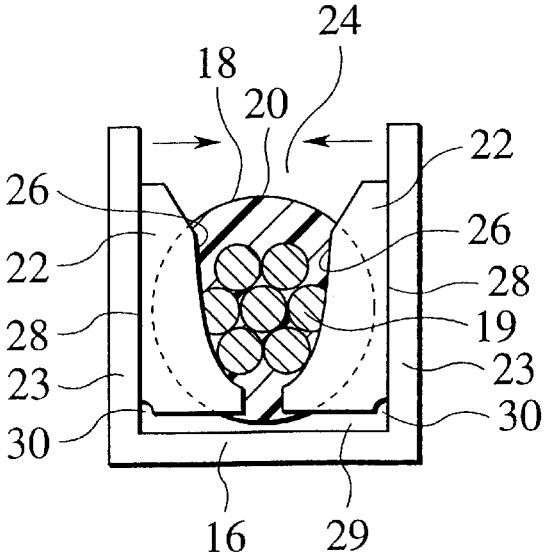
FIG. 5B is a side view illustrating a clad electric wire that has been subjected to insulation displacement contact.

FIGS. 5A and 5B illustrate the clad electric wire 18 that is insulation displacement contacted according to this embodiment. The clad electric wire 18 has the core wire 19, and an insulative clothing portion 20 that clothes the core wire 19. First, as illustrated in FIG. 5A, the clad electric wire 18 is press inserted into the insulation displacement contact slot 24.

As a result of this, the introduction portion 25 guides the clad electric wire 18 into the insulation displacement contact slot 24 while being caused to cut into the clothing portion 20. Accordingly, the clad electric wire 18 can be smoothly introduced into the insulation displacement contact slot 24.

When continuing to be further inserted, the clad electric wire 18 is moved along the V-shaped insulation displacement contact slot 24. As a result of this, the contact portion 26 is caused to cut further deep into the clothing portion 20 and then is conducted to and contacted with the core wire 19 inside the clothing portion 20 as illustrated in FIG. 5B.

Finally, the core wire 19 presses the projecting portion 31. Whereby, the paired contact plates 22, 22 are tilted in the direction of their being moved toward each other as indicated by the arrows. Therefore, the contact portions 26 are contacted with the core wire 19 with a high-contact load, with the result that the contact portion 26 and the core wire 19 can be mutually conducted to each other in a state where the resistance to contact is low.

It is to be noted that since the buffer groove portions 30 permit a stress, that occurs when the contact plates 22, 22 are tilted, to be dispersed, the contact plates 22, 22 can be reliably tilted.

Also, since the contact portions 26 are contacted with the core wire 19 with a high contact load, the clad electric wire 18 is firmly held. Accordingly, with the provision of no folded-back piece, etc., it is possible to prevent the draw-off of the clad electric wire 18 with a simple structure of only the mere contact plates 22 alone.

Further, since the width of the insulation displacement contact slot 24 decreases toward the bottom plate 16, the contact plates 22 reliably cut into the clothing portion 20 of even the clad electric wire 18 having a different diameter. For this reason, it is also possible to cope even with a plurality of the clad electric wires 18 having different diameters. This widens the availability of the terminal. In addition, since the width of the insulation displacement contact slot 24 decreases in the insertion direction of the clad electric wire 18, the core wires 19 converge without being loosened. Accordingly, the degree of mutual contact between each of the core wires 19 is also increased.

Figure 6:
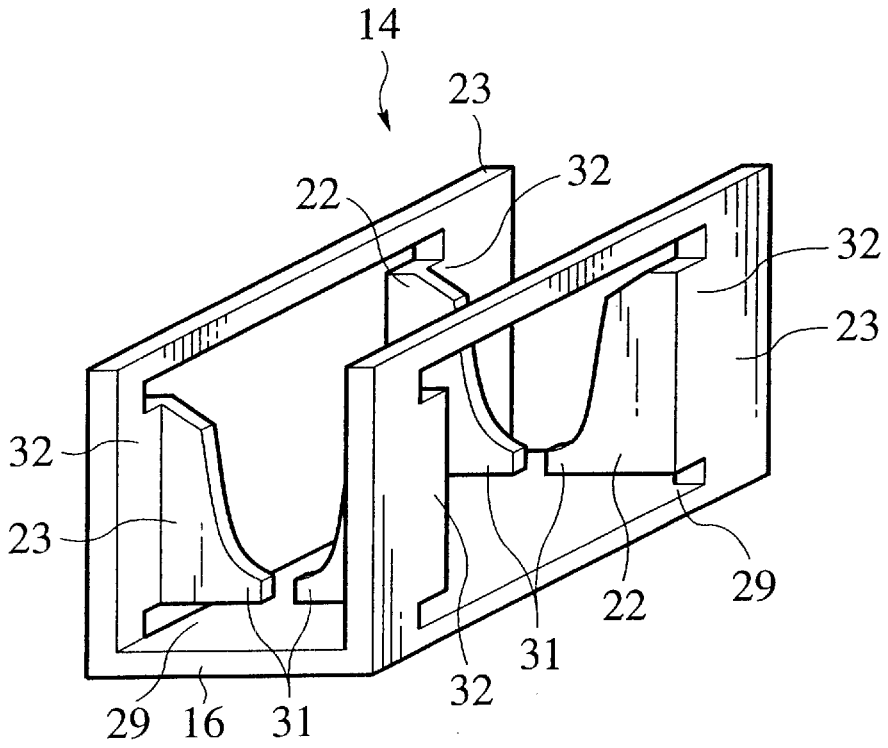
FIG. 6 is a perspective view illustrating a modification of the insulation displacement contact portion.
Figure 7:
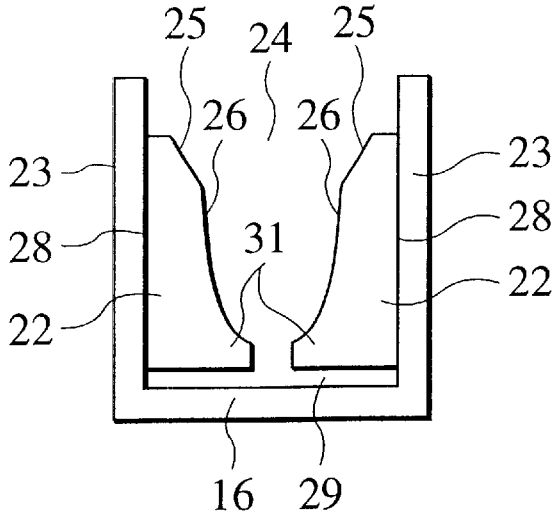
FIG. 7 is a side view illustrating the insulation displacement contact portion of FIG. 6.

FIGS. 6 and 7 illustrate a modification of the insulation displacement contact portion 14. In this modification, as illustrated in FIG. 6, the paired contact plates 22, 22 are cut and bent, respectively, from connecting portions 32 extending in the plane direction of the side plates 23 so that these contact plates 22, 22 may oppose each other. The connecting portion 32 and the corresponding contact plate 22 are floated from the bottom plate 16 so as to have a corresponding gap 29.

By the contact plate 22 being cut and bent from the connecting portion 32, the contact plate 22 goes somewhat separated from the side plate 23. Therefore, when the core wire 19 has pressed the projecting portion 31, the contact plate 22, 22 can be easily tilted. As a result of this, the resistance to contact between the core wire 19 and the contact plate 22, 22 becomes low and so the draw-off of the clad electric wire 18 is prevented.

Figure 8:
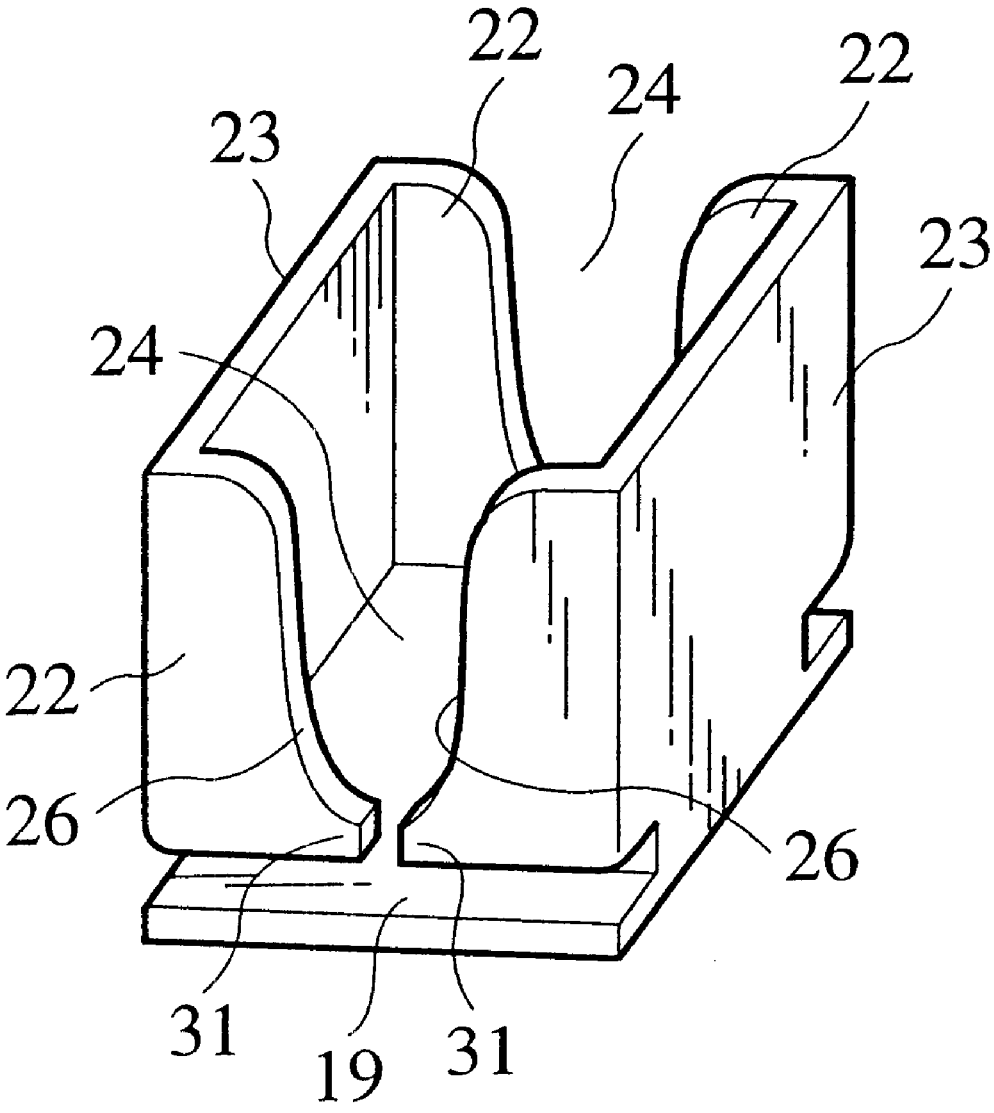
FIG. 8 is a perspective view illustrating another modification of the insulation displacement contact portion.

FIG. 8 illustrates another modification of the insulation displacement contact portion 14. In this modification, the contact plates 22, 22 are formed by cutting and bending respective both end portions in the lengthwise direction of the side plates 23. In this structure, the tilting forces of the contact plates 22, 22 act on the respective both end portions of the side plates 23, 23, and therefore the side plates 23, 23 are easily deformed and aid the tilting movements of the contact plates 22, 22.

Figure 9:
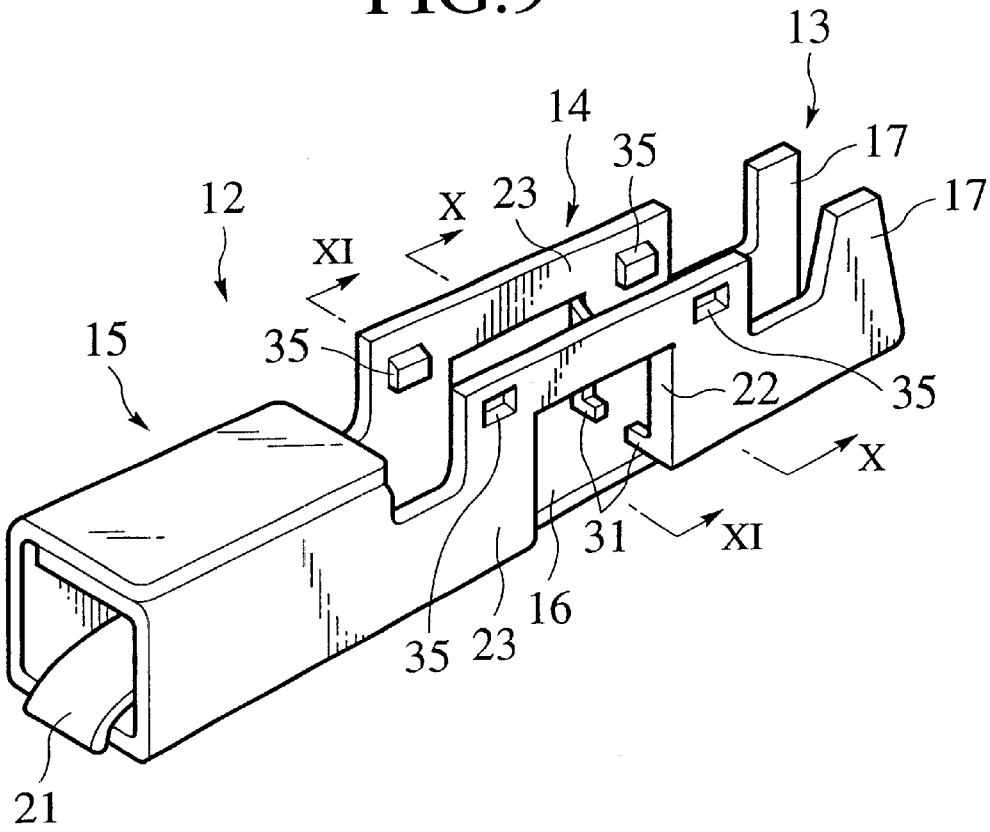
FIG. 9 is a perspective view illustrating an insulation displacement contact terminal as a whole according to another embodiment of the present invention.
Figure 10:
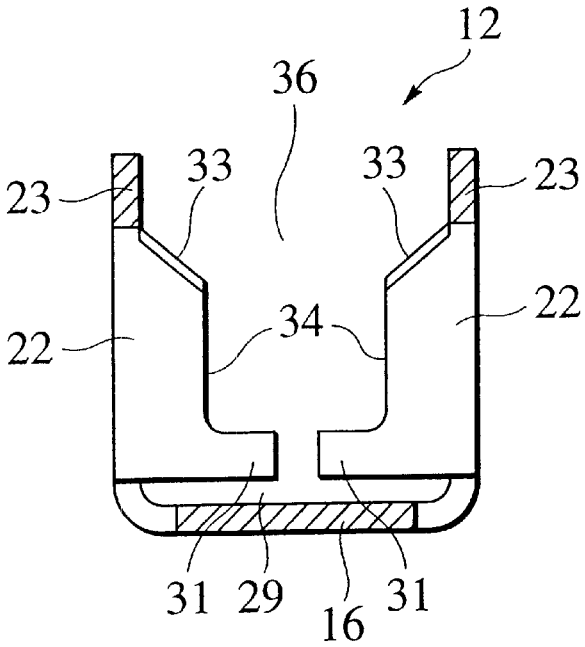
FIG. 10 is a sectional view taken along a line X—X of FIG. 9.

FIGS. 9 to 11 illustrate an insulation displacement contact terminal 12 according to another embodiment of the present invention. Throughout these figures, the same portions as those in the above-described embodiment are denoted by like reference numerals and are thereby made to correspond to them. The paired contact plates 22, 22 are cut and bent from their corresponding side plates 23, 23 that extend from the bottom plate 16. Between the paired contact plates 22 and 22, an insulation displacement contact slot 36 is defined.

As illustrated in FIG. 10, each of the mutually opposing edges of the contact plates 22, 22 has an introduction portion 33 and a contact portion 34. The introduction portion 33 is formed in the form of a blade on a side (the upper part of the illustration) wherein the clad electric wire 18 is inserted. The introduction portion 33 is inclined with respect to the formation direction (the vertical direction with respect to the bottom plate 16) of the insulation displacement contact slot 36. The contact portion 34 extends from the introduction portion 33 toward the bottom plate 16 substantially vertically to this bottom plate 16. The introduction portion 33 guides the clad electric wire 18 into the insulation displacement contact slot 36 and is caused to cut into the clothing portion 20. The contact portion 34 is caused to cut into the clothing portion 20 and is thereby contacted with the core wire 19.

At the upper parts of the paired side plates 23, 23, engagement convex portions 35, 35 are formed in such a way as to oppose each other. Each one of the engagement convex portions 35, 35 is formed by partly cutting the upper portion of the side plate 23 and raising the same. The engagement convex portions 35, 35 are engaged with the clad electric wire 18 that has been press inserted into the insulation displacement contact slot 24, and retain the clad electric wire 18, and prevent the floatation of the clad electric wire 18.

In this embodiment, as illustrated in FIG. 11, it suits the clad electric wire 18 that has the core wires 19 whose diameter is relatively large. First, as illustrated in FIG. 11A, the clad electric wire 18 is press inserted into the insulation displacement contact slot 36.

Figure 11A:
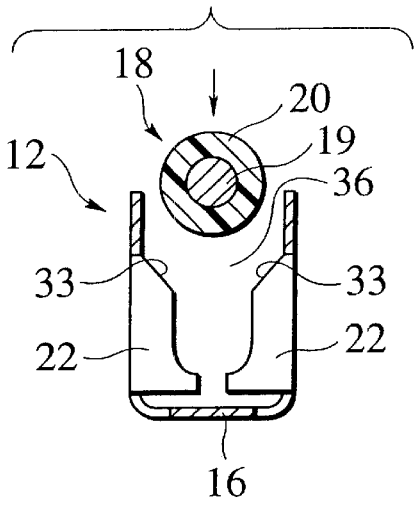
FIG. 11A is a sectional view taken along the line X—X of FIG. 9, illustrating a clad electric wire prior to insulation displacement contact.
Figure 11B:
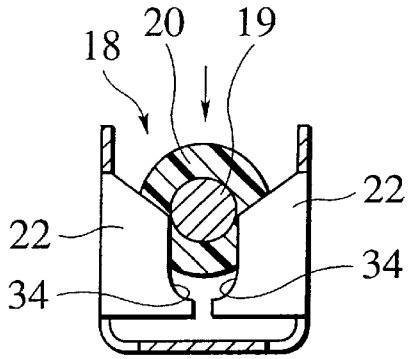
FIG. 11B is a sectional view taken along the line X—X of FIG. 9, illustrating the clad electric wire immediately before insulation displacement contact.
Figure 11C:
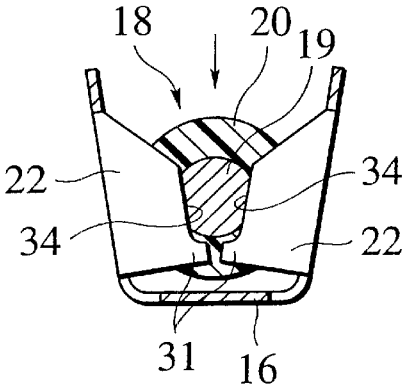
FIG. 11C is a sectional view taken along the line X—X of FIG. 9, illustrating the clad electric wire midway during insulation displacement contact.
Figure 11D:
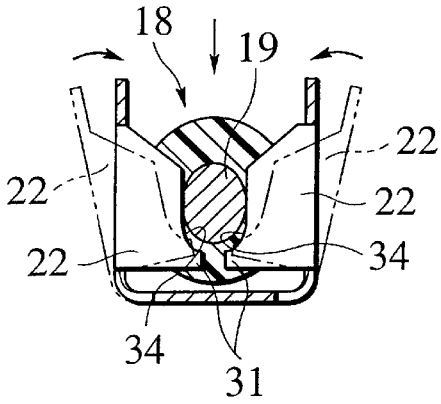
FIG. 11D is a sectional view taken along the line X—X of FIG. 9, illustrating the clad electric wire that has undergone insulation displacement contact.

As a result, as illustrated in FIG. 11B, the introduction portion 33 cuts into the clothing portion 20. When continuing to be further inserted into it, the clad electric wire 18, as illustrated in FIG. 11C, is moved along the end surfaces (contact end surfaces 34) of the contact portion 33, whereby the contact end surfaces 34 contact with the core wire 19. At this time, the contact plates 22, 22 are tilted by the core wire 19 in the direction of their being moved away from each other.

Finally, the core wire 19 presses the projecting portions 31. For this reason, the contact plates 22, 22 are moved in the direction of the arrows in FIG. 11D (as from the chain lines to the solid lines), whereby the contact plates 22, 22 are moved toward each other. Therefore, the contact end surfaces 34 are contacted with the core wire 19 with a great contact load, whereby the resistance to contact decreases. Also, the clad electric wire 18 is firmly held and so the draw-off of the clad electric wire 18 is prevented.

Figure 11E:
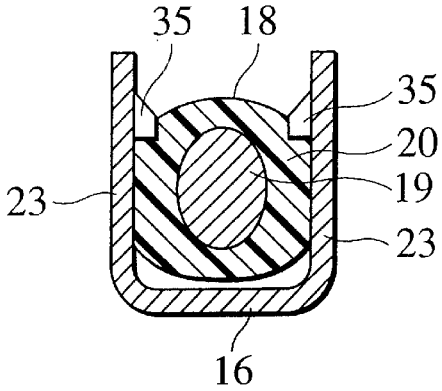
FIG. 11E is a sectional view taken along a line XI—XI of FIG. 9, illustrating a clad electric wire that has undergone insulation displacement contact.

As illustrated in FIG. 11E, the upper part of the clad electric wire 18 that has been sufficiently inserted into the insulation displacement contact slot 36 is engaged with the engagement convex portion 35. Therefore, the floatation of the clad electric wire 18 is prevented, with the result that the clad electric wire 18 is stably retained within the insulation displacement contact slot 24.

In such an embodiment as has been described above, even when the clad electric wire 18 is large in diameter, the clad electric wire 18 and the terminal 12 are reliably conducted to and contacted with each other without making the terminal 12 large in size. And in addition, the clad electric wire 18 can be stably retained.

Additionally, in the present invention, the contact plates 22, 22 have only to be provided at least one pair in number and are not limited in number. Also, the side plates 23, 23 illustrated in FIGS. 1 to 5B may have provided thereon the engagement convex portions 35 illustrated in FIGS. 9 to 11E. Also, the insulation displacement contact slot 36 illustrated in FIGS. 9 to 11E may be used as the V-shaped insulation displacement contact slot 24 illustrated in FIGS. 1 to 5B.

What is claimed is:

1. An insulation displacement contact terminal comprising:

a bottom plate;

a pair of side plates that extend from both side edges of the bottom plate and oppose each other;

a pair of contact plates that are partly bent respectively from the side plates and oppose each other;

gaps provided between the contact plates and the bottom plate, the gaps permitting the contact plates to be moved in a direction of their being moved toward each other;

a slot for receiving a clad electric wire therein, the clad electric wire having a core wire and a clothing portion that clothes the core wire, the slot being defined by edges of the contact plates, the slot having width that decreases with the movement of the contact plates, whereby with the press insertion of the clad electric wire into the slot, the edges are caused to cut into the clothing portions and to contact with the core wire; and projecting portions that respectively project from the contact plates, the projecting portions being disposed only at a bottom of the slot and made to oppose each other, whereby the clad electric wire that has been pressed toward the bottom plate is made to press the projecting portions, wherein a distance between the respective projecting portions determines the smallest width of the slot and whereby the movement of the contact plates in the direction of their being moved toward each other is thereby caused.

2. An insulation displacement contact terminal according to claim 1, wherein each of the edges of the contact plates has an introduction portion that guides the clad electric wire into the slot and a contact portion that cuts into the clothing portion to contact the core wire.

3. An insulation displacement contact terminal according to claim 1, wherein each of the side plates has an engagement convex portion that is engaged with the clad electric wire in order to retain the clad electric wire that has been pressed inserted into the slot.

4. An insulation displacement contact terminal according to claim 1, wherein the width of the slot decreases toward the bottom plate.

5. An insulation displacement contact terminal according to claim 4, wherein each of the edges of the contact plates has an introduction portion that guides the clad electric wire into the slot and a contact portion that cuts into the clothing portion to contact the core wire.

6. An insulation displacement contact terminal according to claim 4, wherein each of the side plates has an engagement convex portion that is engaged with the clad electric wire in order to retain the clad electric wire that has been press inserted into the slot.

* * * * *